United States Patent [19]

DiMatteo

[11] 3,996,990

[45] Dec. 14, 1976

[54] SCULPTURE FABRICATING METHOD

[75] Inventor: Paul L. DiMatteo, Huntington, N.Y.

[73] Assignee: Dynell Electronics Corporation, Melville, N.Y.

[22] Filed: Feb. 24, 1975

[21] Appl. No.: 552,113

[52] U.S. Cl. ..... 164/17; 33/1 G; 164/34

[51] Int. Cl.[2] ..... B22C 9/04; G01B 3/14

[58] Field of Search ..... 164/246, 17, 33, 34, 164/35, 25, 45; 249/61; 35/26; 33/1 C, 1 Q, 1 G

[56] References Cited

UNITED STATES PATENTS

| | | | |
|---|---|---|---|
| 3,041,688 | 7/1962 | Wilder | 164/25 |
| 3,259,949 | 7/1966 | Moore | 164/34 |
| 3,424,226 | 1/1969 | Steele | 164/35 UX |

FOREIGN PATENTS OR APPLICATIONS

| | | | |
|---|---|---|---|
| 440,296 | 12/1935 | United Kingdom | 164/35 |

*Primary Examiner*—Richard B. Lazarus
*Assistant Examiner*—John S. Brown
*Attorney, Agent, or Firm*—Max Fogiel

[57] ABSTRACT

A method for producing sculptures which have a thin-walled outer metal shell and an internal soft core made of plaster, for example. A mold of the sculpture to be fabricated is constructed smaller by the thickness of the metallic outer shell. A substance which can withstand high temperatures when coming into contact with molten metal, such as plaster, is then poured into the mold. After the plaster cast is removed from the mold, a layer of wax is applied with a thickness exceeding the thickness of the final metallic shell. The final shape of the sculpture is then cut on the exterior surface of the wax, so that the wax layer has a thickness corresponding to the thickness of the outer metallic shell. The cut wax layer is then covered with plaster, and heat is applied to melt the wax and allow the wax to drip out through an opening in the outer plaster layer. Metal is afterwards poured in molten state, into the space left vacant by the wax, and the outer plaster is removed after solidification of the metal to leave a thin-walled metal shell of the sculpture with an interior soft core.

17 Claims, 11 Drawing Figures

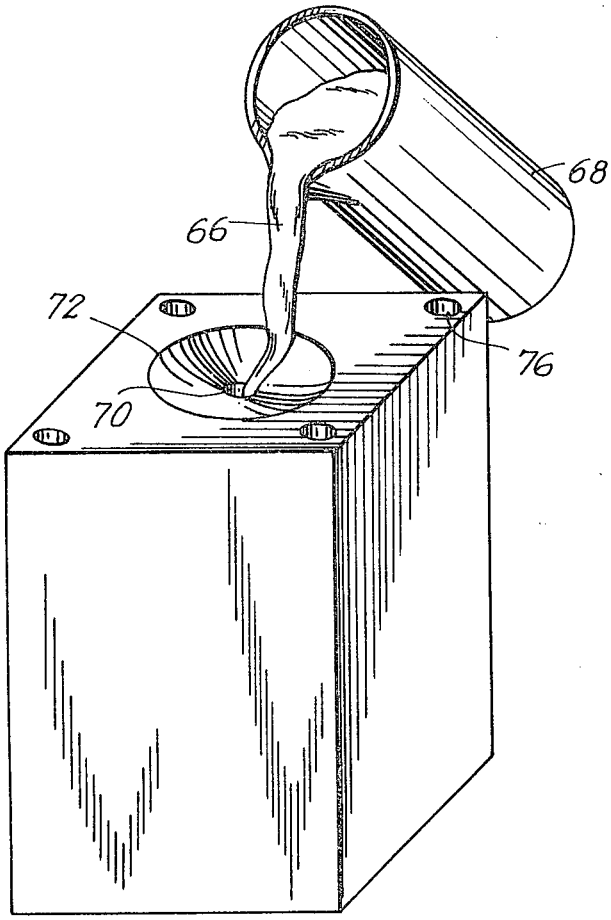
FIG. 9
FIG. 10
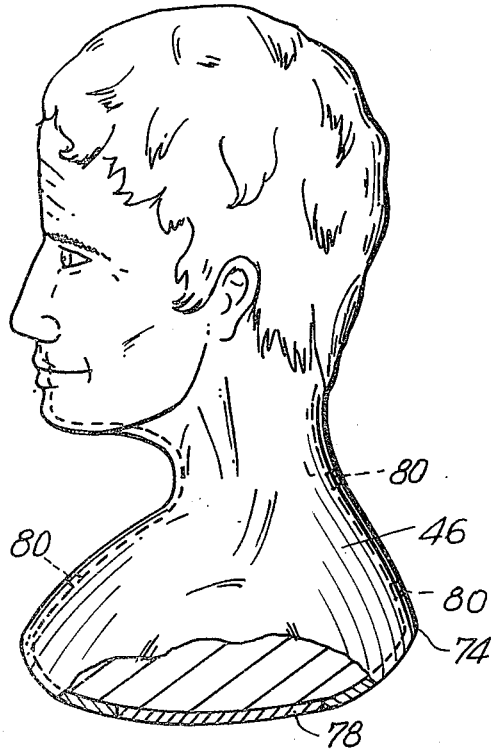

SCULPTURE FABRICATING METHOD

BACKGROUND OF THE INVENTION

In the fabrication of sculptures or busts as known in the art, a mold of a person's face or head is made by applying latex or clay or other soft material against the person's features to obtain an impression thereof. To obtain the necessary impression, the clay, latex or soft material being used, is applied with substantial pressure against the face or head of the person whose bust is to be fabricated. Such pressure results in substantial distortion of the features, and the resulting impression or mold which is left, often does not resemble the true appearance of the person. As is well known in the art, a slight variation in the profile or contour of the cheeks, chin or other soft areas of the face, for example, will result in a substantial change in the facial appearance. This aspect is also particularly applicable to a person's hair. It is almost inevitable that the arrangement of a person's hair will change with the application of molding material, regardless of how delicately and light pressure the molding material is applied.

After the mold has been produced by the conventional method described above, further distortions of the true appearance of a person results from the shrinkages of the metal during solidification, after being poured into the mold in molten state.

When pouring the molten metal into the mold, heretofore, either a solid casting is produced, or one which has an interior air space, for example. If a solid casting is poured, considerable difficulties are encountered with respect to cracking, uneven shrinkages, and final weight of the sculpture. In solidification, the hot metal in contact with the surface of the mold tends to solidify first, and the molten interior will solidify at a considerably later time. These different stages of solidification of the poured metal, produces stresses which result in cracking, deformities and generally weak areas in the sculpture.

If the metal for the sculpture is poured so as to leave a central or interior air space, for example, a metal shell is obtained, but this shell is of non-uniform thickness. The thickness of the metal shell, for example, will be thicker in the vicinity of the nose tip and lips, for example, than at the back of the head. Such non-uniform in thickness results in corresponding non-uniform soldification with the accompanying problems of cracking and distortions in the casting, as described above.

Accordingly, it is an object of the present invention to provide a method for fabricating a sculpture which has a metal outer shell and an interior soft core, with the exterior dimensions of the sculpture being a precise replica of a predetermined surface.

Another object of the present invention is to provide a method for fabricating sculptures in which the metal shell of the sculpture has a uniform thickness.

A further object of the present invention is to provide a method for fabricating sculptures and busts, in which the aforementioned metal shell has a substantially thin wall.

A still further object of the present invention is to provide a method for fabricating sculptures and busts having maximum structural strength with the least amount of metal used in the shell.

It is a particular object of the present invention to provide a method for the fabrication of sculptures and busts which results in a metal shell that is free of cracks, distortions, and areas of weakness.

SUMMARY OF THE INVENTION

The objects of the present invention are achieved by providing a method in which the final surface of the sculpture or bust is specified in detail by taking measurements, for example, at closely spaced points on the surface. The resultant of the final surface of the sculpture are then adjusted by computation so as to result in a set of dimensions which correspond to the surface reduced in size by the amount of the thickness of the metal shell. In particular, the computational adjustments are made, taking into account that the adjustments must be applied perpendicular to the surface in order to obtain a true replica.

A mold is then fabricated or cut using the reduced dimensions of the final sculpture surface, which are derived in the manner described above. After the mold is filled with plaster or other material which can withstand high temperatures when coming into contact with molten metal, the mold is removed to leave a plaster cast, for example, which is smaller in size than the final sculpture surface, by the amount of the thickness of the metal shell.

Wax is thereafter applied to the plaster cast, so that the final thickness of the wax layer exceeds the thickness of the final metal shell.

The true final shape of the surface to be present on the sculpture, is then cut on the exterior surface of the wax. The wax is cut so that the thickness of the resultant wax layer is measured normal to the final true surface of the sculpture.

Thereafter the wax is covered with plaster, and after the latter has solidified, heat is applied to melt the wax and allow it to drip out through a suitable opening in the outer plaster layer. Metal such as bronze, for example, is then poured in molten state into the space left vacant by the wax.

After removal of the outer plaster, a sculpture is obtained with a thin-walled metal shell and a soft interior, with the exterior surface of the metal shell corresponding precisely in dimensions to a desired surface to be reproduced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 9 is a perspective view and shows the method of casting the external metal shell; and FIG. 10 is a perspective view and shows the arrangement of the final sculpture with a thin-walled external metal shell and a soft interior, in accordance with the present invention.

DESCRIPTION OF THE PREFERRED EMBODIMENTS

Figure 1:
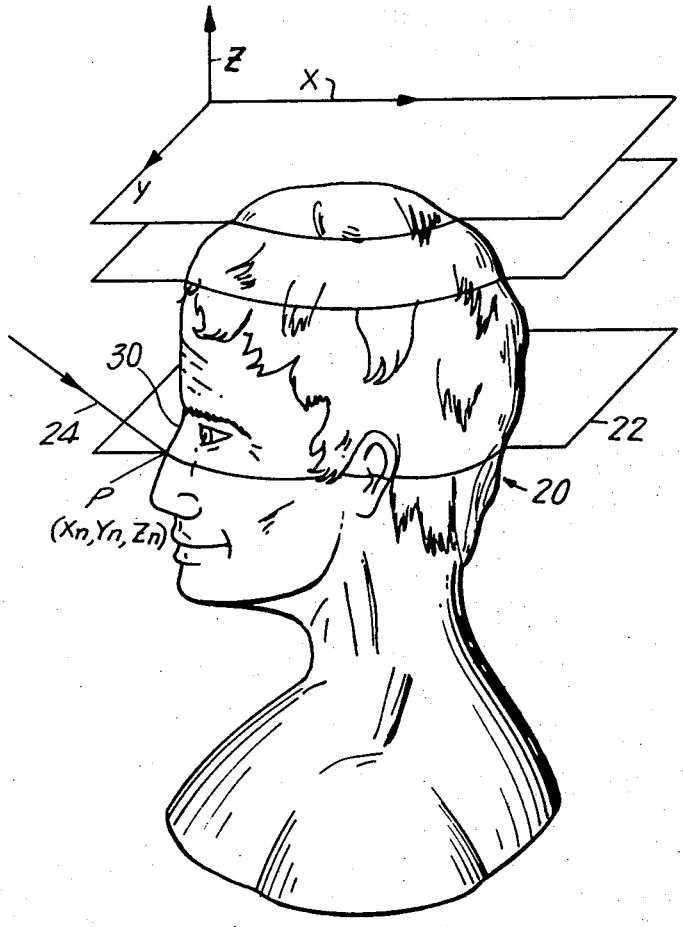
FIG. 1 is a perspective view and shows the method for obtaining the dimensions and measurements of a person's head to be reproduced in the form of a sculpture, in accordance with the present invention.

Referring to the drawing, and in particular to FIG. 1, there is shown the head 20 of a person, which is to be reproduced for example, in the form of a sculpture. To obtain the characteristics of the facial features and other parts of the head 20, the latter is subdivided into sections for which measurements are taken, so that the person's head can be defined in terms of dimensions.

Thus, each point on the surface of the person's face and other parts of the head can be assigned a set of coordinates in space such as $x$-$y$-$z$. To obtain such a set of spatial coordinates for points on the surface of the head 20, the latter may be subdivided into sections by means of parallel planes stacked in the Z direction, as shown in FIG. 1. For purposes of clarity, only three such subdividing planes are shown. In a practical application of the present invention, a substantially large number of such parallel planes are used to obtain a precise definition of the external surface characteristics of the head 20.

Referring to a typical subdividing plane 22, for example, this plane intersects the head 20 along the line or intersecting contour 22*a*. All points lying on this intersecting line 22*a*, have the same Z coordinate, as for example, $Z_n$. The X-Y coordinates of a point P on the intersecting line, can then be determined by any one of a number of measuring methods known in the art. Thus, it is possible to carry out the measuring method by resorting merely to manual means. At the same time, it is possible to carry out the measuring process with the aid of mechanical techniques which include contact and contactless methods. For example, contour followers are well known in the art which can follow an irregular contour or profile by being in contact with the surface under analysis, or by resorting to combinations of electrostatic techniques associated with contactless methods. Since contour followers of a variety of species are already known in the art, these are not further described in detail here.

Consequently, by the use of contour followers as described above, it is possible to obtain coordinates $X_n$, $Y_n$, $Z_n$ of any point P (FIG. 1) for example. To obtain an accurate reproduction of the head 20, it is essential to select closely-spaced points and to obtain their coordinates. This involves spacing the intersecting planes such as plane 22 closely to each other, and selecting points in close proximity to each other along the lines of intersecting such as line 22*a*. By selecting closely-spaced points, in this manner, a substantially high resolution is obtainable and a correspondingly accurate reproduction of the head 22 can be had.

When finding the coordinates $X_n$, $Y_n$, $Z_n$ of the point P, it is also essential to find, at the same time, the directions of the perpendicular or normal line to the surface at that point P. The reason for requiring the directions of the normal to the surface at the point P, may be seen from FIGS. 2 and 3.

Figure 2:
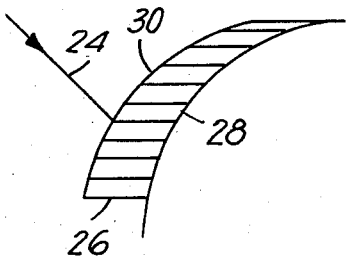
FIG. 2 is a schematic diagram and shows the arrangement which prevails when measurements are not taken normal to the surface to be reproduced.

After the coordinates of all points such as P have been found, it is necessary to carry out computations with these coordinates to calculate the external shape of the head 20 in reduced size, by the amount of the thickness of the metal shell. The directions of the normal or perpendicular 24 to the point P are involved directly in the computations for the outer surface of reduced size. Referring to FIG. 2, there is shown the result of a metal shell that would result if the computations for the wall thickness of the shell were carried out on the basis that the dimension of the thickness 26 be taken along a line lying in the planes parallel to the Z axis, such as plane 22, for example. It may be seen from FIG. 2, that as a result of the curvature of the surface at the point P in FIG. 1, for example, a non-uniform wall thickness would result, even though lines 26 of uniform length would be used to give the coordinates of the reduced-sized surface 28. Thus, if the surface 30 corresponds to the coordinates of points obtained directly by measurements of the head by the process shown in FIG. 1, then the surface 28 in FIG. 2 is not a true reduced-sized portion of the surface 30. A proper reduced-sized portion of the surface 30 may be obtained by resorting to the technique of FIG. 3 in which the thickness of the shell or wall 26, is measured normal to the surface 30 at every point. Under those conditions, the reduced-sized surface 32 is a reduced replica of the surface 30 with uniform wall thickness. The desired arrangement of FIG. 3, therefore, is obtained by measuring the thickness of the wall 26 of the metal shell in the direction which is normal to the surface at the point P.

Figure 3:
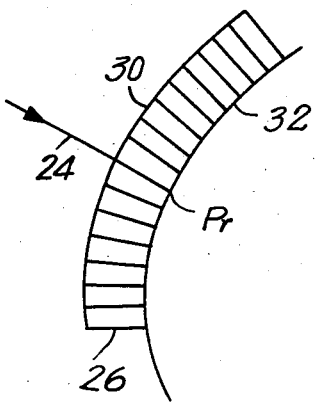
FIG. 3 is a schematic diagram and shows the arrangement which prevails when measurements are taken normal to the surface which is to be reproduced in the form of a sculpture.

To obtain the desired surface 32 shown in FIG. 3, furthermore, it is necessary to compute a point $P_r$ for every point P. The coordinates of a typical point $P_r$ are computed from the parameters of the thickness of the wall 26 and the directions of the normal 24. Such computations are readily carried out with the aid of computers, and since such computations are already well known in the art with regard to numerically-controlled milling machines, these computations are not further described here in detail. It is also to be noted, at the same time, that it is not essential to measure directly the direction of the normal 24 at the point P. The directions of such a point P may be computed by taking into account the coordinates of adjacent points in the vicinity of point P, and generating or tracing mathematically the portion of the surface defined by such points in the vicinity of P. By defining such a surface portion computationally from its coordinates, it is possible to compute the tangent and hence the normal to the surface at any typical point, such as point P.

Figure 2A:
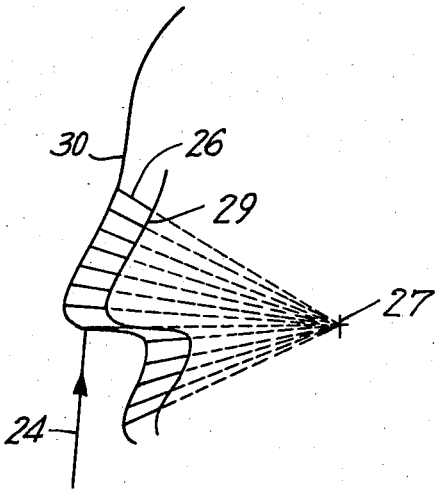
FIG. 2*a* is a schematic diagram and shows a non-uniform wall thickness produced when thickness measurements are taken along radial lines which are not normal to the surface.

FIG. 2*a* shows schematically the non-uniform wall thickness resulting when lines 26 of uniform length are taken along radial lines with respect to a center 27 which may correspond to the center of the head, for example. The reduced surface 29 is, thereby, not equidistant from surface 30.

Figure 4:
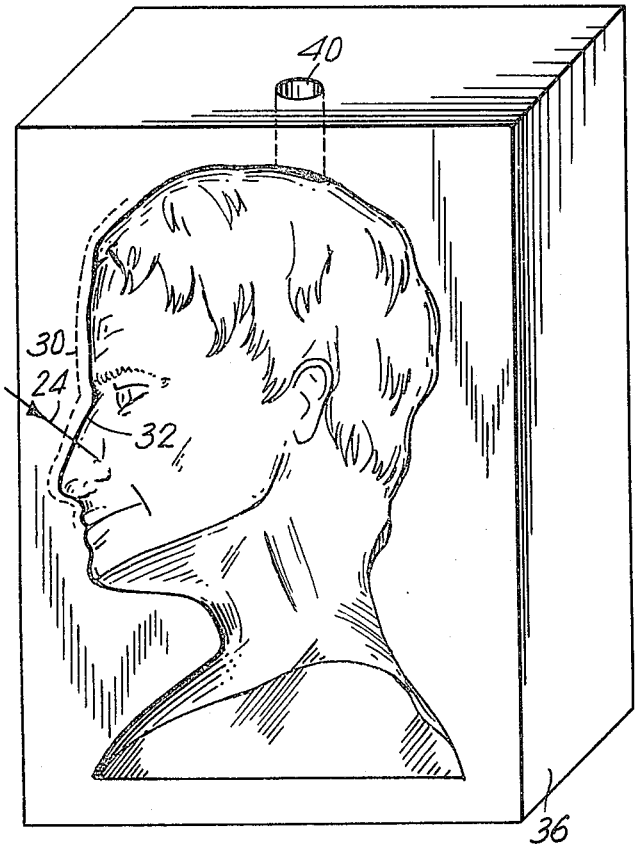
FIG. 4 is a perspective view and shows the mold fabricated from the measurements taken in the procedure of FIG. 1.

Once the coordinates of points of a surface to be reproduced have been defined in the manner described above, and corresponding points for the reduced surface such as $P_r$ have been computed correspondingly, it is possible to store the computed points for the reduced-sized surface 32 in a computer, magnetic tape, punched tape, or any one of the other memory devices known in the art. The coordinate information of the surface 32 may then be used to control a machine tool for the purpose of forming or cutting a mold 36. For purposes of clarity, only a half-section of the mold 36 is shown in FIG. 4. Thus, in FIG. 4, the mold is formed to correspond to the reduced-sized surface 32, and this surface 32 is shown relative to the desired final true surface 30 (dashed lines) and normal 24. The mold 36 may be made of substantially soft and inexpensive material, since only plaster will be introduced into the cavity of the mold.

Whereas a numerically-controlled machine tool may be used for forming the mold 36, manual carving and shaping techniques may also be used for this purpose. The use of numerically-controlled machine tools for this purpose is already known in the art as, for example, in the die sinking industry.

After the mold 36 has been formed in the manner described above, it is mated with a corresponding mold section 38 also formed by similar techniques to reproduce a cavity which corresponds to the full head 20. After the two mold sections 36 and 38 are brought together, plaster of paris, for example, is introduced into the mold cavity through openings 40 and 42. By providing more than one opening for this purpose, such as opening 40, the plaster may be introduced into the mold at a faster rate and thereby assure that a more uniformly solidified plaster cast may be obtained. To aid in introducing the plaster into the openings 40 and 42 which communicate with the mold cavity, a funnel 44 may be used. The openings or ducts 40 and 42 leading from the exterior of the mold to the interior cavity thereof, may be cut or formed in the mold at the time that the surface 32, for example, is formed in the mold.

Figure 6:
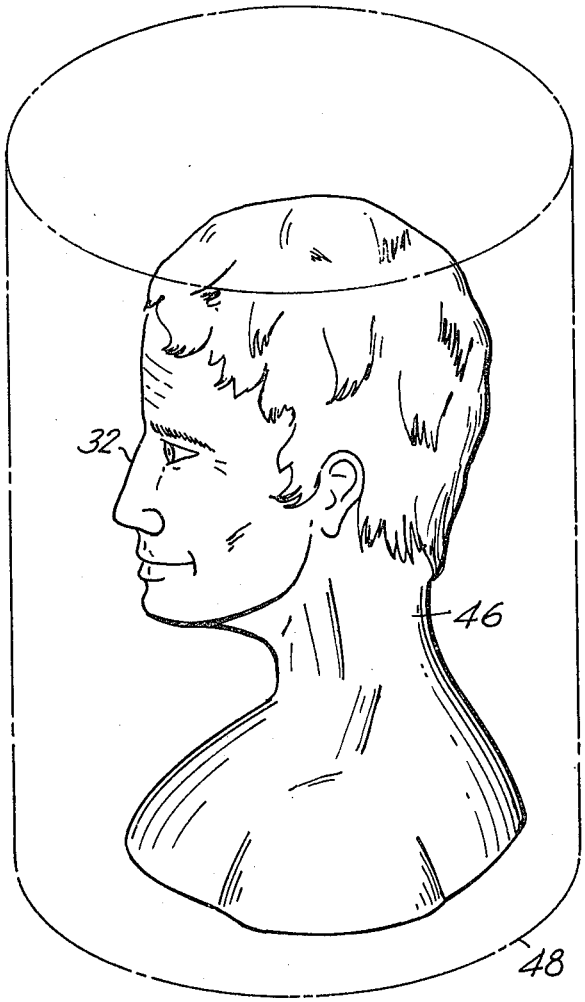
FIG. 6 is a perspective view and shows the method for covering the plaster cast, derived from FIG. 5, with wax.
Figure 5:
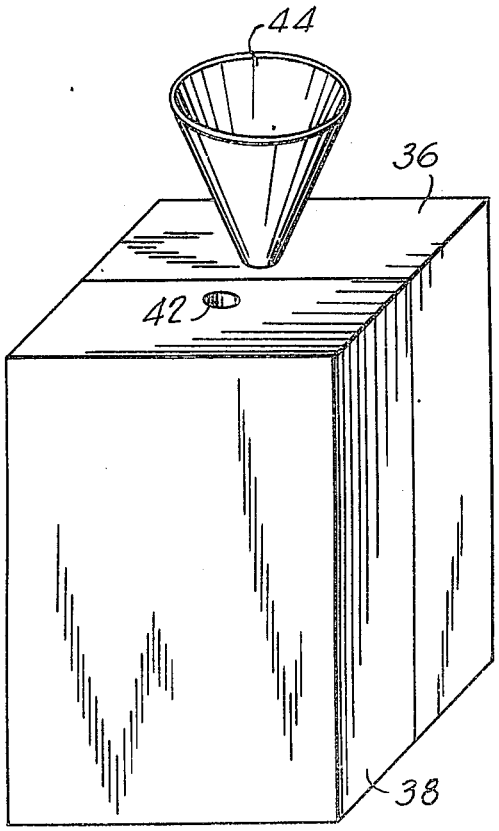
FIG. 5 is a perspective view and shows the method for filling the mold of FIG. 4 with plaster or other suitable soft material.

After the plaster in the mold sections 36 and 38 has set and become solidified, these mold sections 36 and 38, shown in FIG. 5, are separated so as to leave a plaster cast 46 as shown in FIG. 6.

The plaster cast 46 is then covered with wax. The wax may be applied by placing the plaster cast 46 within a hollow cylinder 48, and then pouring melted wax in the space between the cast 46 and the interior wall of the cylinder 48. After the wax has solidified, and the hollow cylinder has been removed, the cast 46 becomes, thereby embedded within a wax cylinder. This configuration may be seen from FIG. 6.

Figure 7:
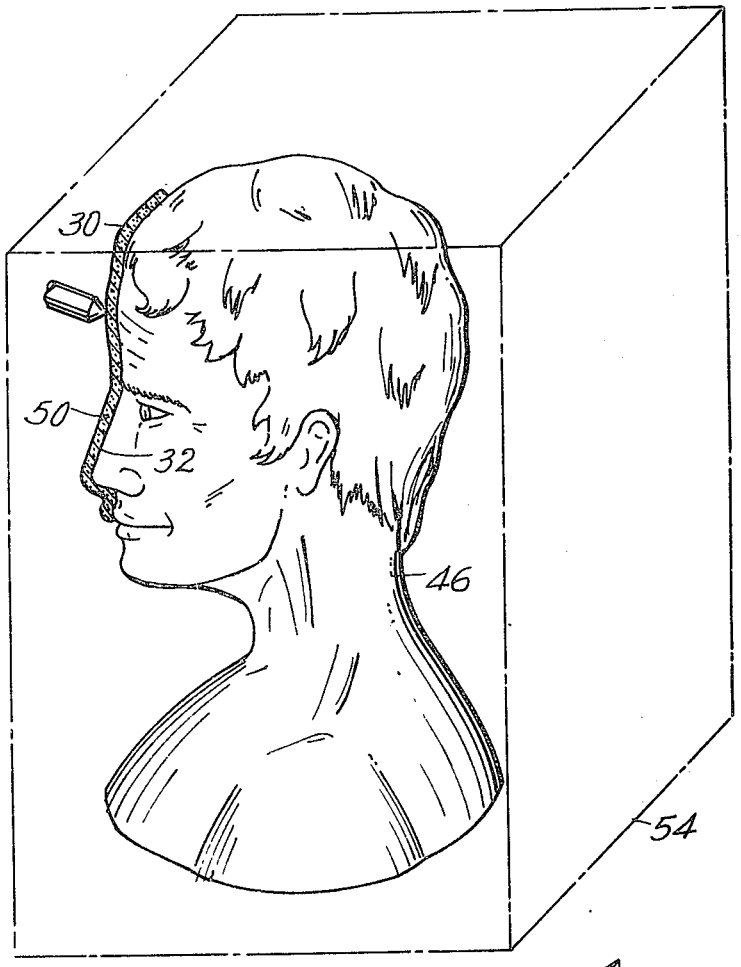
FIG. 7 is a perspective view and shows the method of producing the exterior surface of the wax layer.

The wax is then cut and removed by a numerically-controlled cutting tool, for example, so as to leave a wall or layer of wax 50 directly on the surface of the plaster cast 46, as shown in FIG. 7. The cutting or removal of the wax, for this purpose, may be achieved by a numerically-controlled milling tool 52 which can be similarly used for producing the mold 36. The layer of wax 50 has a thickness corresponding precisely to the thickness of the desired resultant metal shell.

The surface of the wax cut by the tool 52 in FIG. 7, for example, has coordinates of the surface 30. The coordinates of this surface 30 were obtained, as described supra, by the measuring method of FIG. 1 taken with respect to the original true surface to be reproduced.

The formation of a wax cylinder to be used in the formation of the layer 50, is useful for this purpose in the respect that it is possible to generate the surface 30 on the wax layer 50 by directing that the tool cut into a predetermined depth from the exterior surface of the wax cylinder. Thus, knowing the dimension of the exterior surface of the wax cylinder, and knowing the coordinates of the points on surface 30, it is possible to then direct the tool 52 to a predetermined step into the wax cylinder, so as to leave a properly-dimensioned wax layer 50.

After the wax layer 50 has been formed, as shown in FIG. 7, the wax surface of the layer 50 is covered entirely with plaster of paris, for example, so that the combination of the cast 46 and wax layer 50 are fully embedded within a plaster configuration 54 shown by dash-dot lines. This plaster configuration 54 may have a box-shape or any other suitable shape for this purpose. In applying this method step of the present invention, the cast 46 with layer 50 thereon, may be placed within a box-shaped unit or mold, and plaster may be poured within the interior surface of the mold and the exterior surface of the layer 50. After the plaster has been allowed to set and solidify, the exterior box-shaped mold or unit is removed so as to leave the box-shaped plaster structure 54 containing the cast 46 and the wax layer 50.

Figure 8:
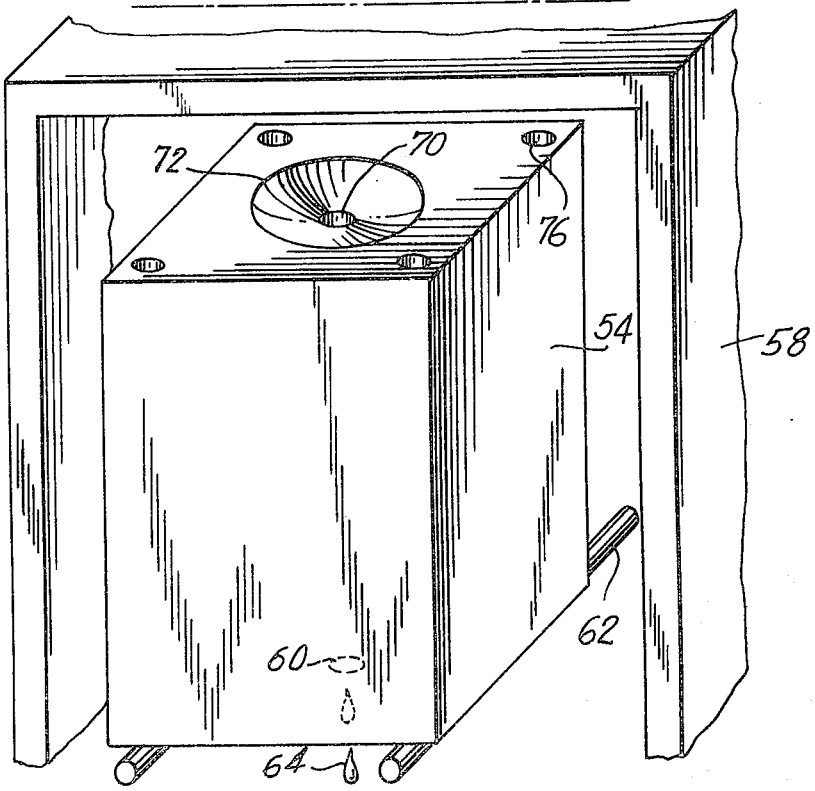
FIG. 8 is a perspective view and shows the arrangement for removing the wax from the interior of the mold of FIG. 7.

The plaster structure 54 is then introduced into a furnace 58 and heated so as to melt the wax present within the structure 54, and allow it to drip out of the structure through a suitable opening 60. This arrangement is shown in FIG. 8 in which the structure 50 is mounted within the furnace 58 on supporting rails 62, and liquid wax droplets 64 drip from the interior of the structure 54 through the opening 60.

After the plaster structure 54 has been sufficiently heated to assure that no wax remains within the interior thereof, molten metal is poured into the space left vacant by the wax. This is accomplished by plugging suitably the opening 60 with refractory material, and then pouring the molten metal 66 from a crucible 68 into the opening 70 formed in the plaster structure 54, at the time that this structure was constructed. Thus, the opening 70 communicating with the wax layer 50 can be formed by placing a taper-shaped member onto the top surface of the layer 50, for example, prior to pouring the plaster to form the box-shaped structure 54. Such a tapered element is often referred to in the art as a sprue. This tapered or sprue element is then removed after the plaster stucture 54 has solidified, and an opening is left leading via a duct directly to the space left after the wax has been removed during the method step shown in FIG. 8.

For purposes of facilitating the pouring of the molten metal 66 into the opening 70, furthermore, a substantially wide-shaped basin or pool 72 is molded or formed on the surface of the structure 54 and communicating with the opening 70. This pool 72 can then hold a substantial quantity of the molten metal prior to passing through the opening 70 and into the space left vacant by the wax.

After the molten metal 66 has been allowed to solidify within the interior of the plastic structure 54, this plastic structure is removed by breaking it away or chipping away parts of the plaster to expose the metal shell 74.

It is to be noted that, in accordance with the present invention, the metal shell 74 has a uniform thickness throughout the entire structure, and this uniform thickness permits the hot molten metal to solidify in a uniform manner. As a result, no residual stresses prevail within the metal shell which cause cracking, deformities, and other defects and areas of weakness in the metal casting. Such uniform thickness of the metal shell 74 can be obtained only by resorting to the method steps of FIGS. 1 – 4. The interior of the metal shell 74, furthermore, is of substantially soft and lightweight material and provides, in addition, economical construction.

Whereas plaster was described as the material to be used for the casting 46 in the embodiments above, any other material which can resist the temperatures of the molten metal 66, can also be used for this purpose. At the same time, the molten metal may be in the form of brass, bronze, and any one of the various non-ferrous and even ferrous materials which may be cast by pouring from a crucible, for example. Furthermore, whereas a wax cylinder is shown in FIG. 6, the wax may be applied in any other suitable shape, provided that the thickness of the wax layer exceeds at least the thickness of the final metal shell 74.

In accordance with the present invention, it is also possible to produce the metal shell 74 so that this shell is very thin-walled. Such a cast substantially thin metal wall allows for very precise reproduction of the final exterior surface, since stresses and deformities are at a minimum, while allowing considerable economies in the metal used for casting.

In accordance with the present invention, furthermore, the surface 30 of which a sculpture is to be made, can be defined by taking measurements as described above in relation to FIG. 1, or this surface can be defined by a set of coordinates derived from computer calculations, for example, or graphical specifications. In the latter technique, a bust or other shape may be designed on graph paper, for example, and the coordinates may be read or taken directly from such a graphical presentation. This graphical presentation may be extended to include three dimensions, so that a set of X-Y-Z coordinates are obtained. These set of coordinates can then be used to guide a numerically-controlled machine tool, for example, to perform the cutting or milling processes associated with FIGS. 4 and 7. A set of coodinates can be obtained, moreover, from computations for specifying curves and general three-dimensional surfaces for use in modelling or construction of particular physical structures. Thus, the method in accordance with the present invention is not confined to the construction of sculptures. Instead, the method can also be used for the construction of models, patterns, and the representation of surfaces and structures defined by equations derived from computational methods. If a surface or relationship involving two independent variables, for example, is specified by equation, then the coordinates can be readily obtained from equations by computational methods performed either manually or by a computer.

In directing the tool 52 to cut the surface 30 onto the wax layer 50, furthermore, the center of the person's head 20 may be used as a reference point for the coordinates of the surface and the position of the tool. Spherical coordinates may be used, for example, in conjunction therewith for the purpose of computing the displacement of the tool 52 from its instantaneous position, to a position where it generates precisely the surface 30 at predetermined points spaced sufficiently close together so as to result in a substantially smooth and continuous surface.

When pouring molten metal 66 into the plaster structure 54, it is often desirable to provide outlets commonly known in the art as risers for the escape of gas products formed as a result of the casting process. Such risers 76 constitute passages or ducts communicating with the interior of the mold into which the molten metal is poured, as well as with the exterior environment or atmosphere. The risers 76, therefore, provide a means for gases generated by the casting process, to escape and thereby prevent defects from being formed in the solidified metal casting.

For the purpose of holding the plaster cast 46 in proper position after the wax layer has been removed by flowing through the opening 60, the plaster cast 46 may be supported by a base portion 78. This base portion may be made as part of the plaster cast 46, for example. On the other hand, the base portion 78 may be a separate portion on which the plaster cast 46 rests. With the base portion 78 shown in FIG. 10, for example, the bottom of the metal shell 74 is left open. In place of the supporting portion 78 or in addition thereto, supporting elements 80 may also be applied. Such elements 80 may be in the form of, for example, pin-shaped members made of refractory material. At the same time, the supporting elements 80 may be made of metal having a substantially higher melting point than of the metal used to form the shell 74.

The method of the present invention when carried out in accordance with the procedure of FIG. 3, provides a metal shell which has maximum structural strength for the least amount of metal used.

Whereas the general method of the present invention provides for a metal shell with uniform thickness, it is also possible to deliberately make the shell non-uniform in thickness at predetermined locations for the purpose of increasing, in particular, the structural strength therein. Thus, at locations where there is generally high stress concentration which results in casting difficulties, it is possible to shape those areas with varying thicknesses in order to avoid the casting difficulties and/or reduce stresses which result during the solidification of the metal.

When pouring metal into the plaster structure 54, it is not essential to provide a separate opening 70 therefor, as shown in FIG. 8. For this purpose, it is also possible to invert the structure 54, so that the opening 60, through which the wax was removed, may then subsequently be used for pouring the metal into the plaster structure and cast the metal shell.

It is also not essential that the internal cast 46 remain within the metal shell 74. For the purpose of reducing the weight of the sculpture or bust, for example, the internal cast 46 may be chipped away from the interior of the metal shell and removed, so as to leave a vacant interior within the shell. Furthermore, the interior cast 46 is not confined to being made of plaster, for example. It is equally feasible to form the interior cast 46 of ceramics or other similar material, for example. Such ceramic material can also be chipped and removed from the interior of the metal shell 74 after solidification thereof.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sculpture fabricating method comprising the steps of: defining the exterior surface of the sculpture to be fabricated; forming a first cast of a first material and having an exterior surface spaced inwardly by a predetermined amount from said exterior surface of said sculpture, the exterior surface of said first cast having profiles corresponding substantially to respective profiles of the exterior surface of said sculpture; covering the surface of said first cast with a layer of predetermined thickness, the exterior surface of said layer being substantially identical to the exterior surface of said sculpture; embedding said first cast with said layer within a second material; removing said layer from the interior of said second material, the removal of said layer leaving a vacant space between said second material and said first cast; filling said vacant space with a third material; and removing said second material to leave said third material exposed with a exterior surface identical to said exterior surface of said sculpture, said step of forming said first cast including the step of controlling the spacing between the exterior surface of said first cast and the exterior surface of said sculpture so that said spacing is of substantially uniform depth, the thickness of said layer being controlled so that said thickness is substantially uniform, the internal surface of said third material having a profile corresponding geometrically to the profile of the exterior surface of said third material, the spacing between said exterior surface of said first cast and said exterior surface of said sculpture being measured normal to both said exterior surfaces.

2. The method as defined in claim 1 wherein said forming step comprises further producing a mold; filling said mold with said first material; and removing said first cast from said mold.

3. The method as defined in claim 1 wherein said layer is of material removable by fluidizing.

4. The method as defined in claim 1 wherein said layer comprises wax.

5. The method as defined in claim 1 wherein said embedding step further comprises pouring said second material over said layer.

6. The method as defined in claim 1 including the step of applying heat for removing said layer from the interior of said second material.

7. The method as defined in claim 1 wherein said filling step comprises further pouring molten metal into said vacant space and allowing said poured metal to solidify.

8. The method as defined in claim 1 wherein said defining step comprises further measuring said surface at predetermined points thereof.

9. The method as defined in claim 1 wherein said first and second materials are of high-temperature resistant material.

10. The method as defined in claim 1 wherein said first and second material comprises plaster.

11. The method as defined in claim 1 wherein said third material comprises metal.

12. The method as defined in claim 1 including the step of cutting said layer for forming the exterior surface of said layer.

13. The method as defined in claim 1 including the step of embedding said first cast within a cylinder of wax and removing portions of said wax to form said layer.

14. The method as defined in claim 1 wherein said defining step comprises further specifying coordinates of predetermined points of said exterior surface of said sculpture to be fabricated.

15. A sculpture fabricating method comprising the steps of: defining the exterior surface of the sculpture to be fabricated; forming a mold with an internal surface spaced inwardly from said exterior surface of said sculpture to be fabricated, the spacing between said interior mold surface and said sculpture exterior surface being measured normal to said sculpture exterior surface and being of predetermined uniform amount; filling said mold with high-temperature resistant material to form a first cast; covering the exterior surface of said first cast with wax to a depth exceeding a predetermined level; removing portions of said wax to form an exterior wax surface coinciding in dimensions to said exterior surface of the sculpture to be fabricated, the exterior surface of said wax layer being spaced from the exterior surface of said first cast by a predetermined amount measured normal to the exterior surface of said first cast and the exterior surface of said wax layer; embedding said first cast with said layer of wax within a high-temperature resistant material; heating said wax layer to melt said wax and remove said wax by drainage from the interior of said last-mentioned high-temperature resistant material to leave a vacant space between the exterior surface of said first cast and the interior surface of said last-mentioned high-temperature resistant material; filling said vacant space with molten metal and allowing said metal to solidify therein; and removing said last-mentioned material to leave said metal exposed with an exterior surface identical to said exterior surface of said sculpture, said step of forming said first cast including the step of controlling the spacing between the exterior surface of said first cast and the exterior surface of said sculpture so that said spacing is of substantially uniform depth, the thickness of said layer being controlled so that said thickness is substantially uniform, the internal surface of said third material having a profile corresponding geometrically to the profile of the exterior surface of said third material, said forming step further comprises machining a mold with a mold surface corresponding to the exterior surface of the sculpture and spaced inwardly at uniform depth from said exterior surface of said sculpture, filling said mold with said first material, and removing said first cast from said mold; said step of covering the surface of said first cast from said mold; said step of covering the surface of said first cast with said layer including the step of machining said layer so that the exterior surface of said layer is substantially identical to the exterior surface of said sculpture, said defining step further comprising specifying coordinates of predetermined points of said exterior surface of said sculpture to be fabricated, said machining step including the step of computing spatial coordinates on said mold surface from spatial coordinates on said exterior surface of said sculpture, said machining being directed among said coordinates to form said mold surface, the machining of said layer being directed among coordinates on said exterior surface of said sculpture.

16. A sculpture fabricating method comprising the steps of: defining the exterior surface of the sculpture to be fabricated; forming a first cast of a first material and having an exterior surface spaced inwardly by a predetermined amount from said exterior surface of said sculpture, the exterior surface of said first cast having profiles corresponding substantially to respective profiles of the exterior surface of said sculpture; covering the surface of said first cast with a layer of predetermined thickness, the exterior surface of said layer being substantially identical to the exterior surface of said sculpture; embedding said first cast with said layer within a second material; removing said layer from the interior of said second material, the removal of said layer leaving a vacant space between said second material and said first cast; filling said vacant space with a third material, and removing said second material to leave said third material exposed with a exterior surface identical to said exterior surface of said sculpture, said step of forming said first cast including the step of controlling the spacing between the exterior surface of said first cast and the exterior surface of said sculpture so that said spacing is of substantially uniform depth, the thickness of said layer being controlled so that said thickness is substantially uniform, the internal surface of said third material having a profile corresponding geometrically to the profile of the exterior surface of said third material, said predetermined thickness of said layer is measured normal to the exterior surface of said layer and the exterior surface of said first cast.

17. A sculpture fabricating method comprising the steps of: defining the exterior surface of the sculpture to be fabricated; forming a first cast of a first material and having an exterior surface spaced inwardly by a predetermined amount from said exterior surface of said sculpture, the exterior surface of said first cast having profiles corresponding substantially to respective profiles of the exterior surface of said sculpture; covering the surface of said first cast with a layer of predetermined thickness, the exterior surface of said layer being substantially identical to the exterior surface of said sculpture; embedding said first cast with said layer within a second material; removing said layer from the interior of said second material, the removal of said layer leaving a vacant space between said second material and said first cast; filling said vacant space with a third material; and removing said second material to leave said third material exposed with a exterior surface identical to said exterior surface of said sculpture, said step of forming said first cast including the step of cntrolling the spacing between the exterior surface of said first cast and the exterior surface of said sculpture so that said spacing is of substantially uniform depth, the thickness of said layer being controlled so that said thickness is substantially uniform, the internal surface of said third material having a profile corresponding geometrically to the profile of the exterior surface of said third material; said forming step further comprising machining a mold with a mold surface corresponding to the exterior surface of the sculpture and spaced inwardly at uniform depth from said exterior surface of said sculpture, filling said mold with said first material, and removing said first cast from said mold; said step of covering the surface of said first cast with said layer including the step of machining said layer so that the exterior surface of said layer is substantially identical to the exterior surface of said sculpture, said machining step including the step of computing spatial coordinates on said mold surface from spatial coordinates on said exterior surface of said sculpture, said machining being directed among said coordinates to form said mold surface, the machining of said layer being directed among coordinates on said exterior surface of said sculpture.

* * * * *